US007186167B2

(12) United States Patent
Joslin

(10) Patent No.: US 7,186,167 B2
(45) Date of Patent: Mar. 6, 2007

(54) SUSPENDED ABRASIVE WATERJET HOLE DRILLING SYSTEM AND METHOD

(75) Inventor: Frederick R. Joslin, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 392 days.

(21) Appl. No.: 10/825,524

(22) Filed: Apr. 15, 2004

(65) Prior Publication Data

US 2005/0230152 A1 Oct. 20, 2005

(51) Int. Cl.
*B24B 1/00* (2006.01)
*B24C 1/00* (2006.01)

(52) U.S. Cl. ..... 451/38; 451/75; 451/91; 451/99; 451/102

(58) Field of Classification Search ..... 451/38, 451/75, 91, 99, 102
See application file for complete search history.

(56) References Cited

U.S. PATENT DOCUMENTS 4,534,427 A * 8/1985 Wang et al. ..... 175/67
4,555,872 A * 12/1985 Yie ..... 451/40
5,184,434 A 2/1993 Hollinger et al.
5,469,926 A * 11/1995 Lessard ..... 175/424
6,329,015 B1 12/2001 Fehrenbach et al.

* cited by examiner

*Primary Examiner*—Lee D. Wilson
*Assistant Examiner*—Shantese McDonald
(74) *Attorney, Agent, or Firm*—Carlson, Gaskey & Olds

(57) ABSTRACT

A suspended abrasive waterjet narrow kerf cutting method is reconfigured to simultaneously drill multiple, closely-spaced holes in a target, including holes in confined non line-of-sight locations. Working fluid nozzles can be located on a flat or non-flat tool surface and arranged in uniform or non-uniform patterns, in an angled or perpendicular orientation, and in parallel or non-parallel arrangements. Individual nozzles or nozzle groups can be easily changed to provide increased or diminished working diameters, allowing control over the hole sizes and resultant airflow thru the drilled workpiece.

25 Claims, 4 Drawing Sheets

SUSPENDED ABRASIVE WATERJET HOLE DRILLING SYSTEM AND METHOD

TECHNICAL FIELD

The present invention is directed to hole drilling, and more particularly to a hole drilling system and method that uses high pressure liquid to drill holes in a part.

BACKGROUND OF THE INVENTION

Many manufacturing applications require hole drilling to form holes in a target product. Mechanical drilling systems are appropriate for forming relatively large holes, but are not suitable for drilling small diameter holes because mechanical drilling methods are unable to drill small holes cleanly within tight tolerances.

Laser systems have been used in hole drilling systems because they can be precisely focused and can drill even small diameter holes relatively cleanly. However, these processes are thermal processes and often cause metallurgical damage in the holes they drill, leaving recast material on the sides of the hole walls that are prone to cracking and failure if highly stressed.

U.S. Pat. No. 5,184,434 to Hollinger et al. ("the '434 patent") illustrates a cutting process using a small diameter jet of high pressure fluid containing abrasive particles to cut a target product. The '434 patent teaches fully wetting the abrasive in the fluid and also teaches treating the abrasive/fluid mixture to prevent the abrasive from settling out of the fluid. By controlling the size of the orifice through which the jet is output, the kerf width of the cut formed by the jet can be quite narrow, allowing the jet to make very fine cuts. However, the '434 patent focuses solely using the jet in a cutting process and does not address the special concerns of hole drilling in any way. As a result, currently known hole drilling systems still rely on mechanical or thermal processes or use a conventional abrasive waterjet hole drilling method using a high pressure waterjet orifice, a mixing chamber to entrain dry abrasive particles, and a focusing tube. The large physical dimensions of conventional waterjet system components severely limits the ability to drill holes in confined spaces and/or in closely-spaced hole patterns.

There is a desire for an improved hole drilling system and method that can drill holes in a target cleanly in closely-spaced patterns, with no thermal damage to the target, simultaneously and in non line-of-sight locations.

SUMMARY OF THE INVENTION

The present invention is directed to a hole drilling system and method that uses coherent abrasive suspension jets to drill holes in a target. Abrasive particles are suspended in a working fluid before the fluid is jetted toward the target by increasing the fluid viscosity before the abrasive material is added to the fluid. To achieve mixing of the water and abrasive prior to the forming of the jet, suitable polymeric materials are mixed with the working fluid water to achieve an increased fluid viscosity, ensuring that the jet that is outputted through the system is coherent rather than divergent to maintain high abrasive particle velocities to drill holes efficiently. Further, by keeping the jet coherent at high velocities, the invention can cleanly drill holes even if the desired holes have small diameters without creating any thermal damage in the hole.

One advantage of the process for hole drilling with a coherent abrasive suspension jet is the elimination of the dry abrasive mixing chamber and focusing tube used in conventional abrasive waterjet hole drilling systems. The coherent abrasive suspension jet utilizes a viscous or viscoelastic suspension that maintains the abrasive in an even distribution throughout the liquid so that it might easily be pumped and passed through the nozzle already mixed. This permits the use of very small and closely spaced orifices to simultaneously drill multiple holes, including shallow-angled holes in confined, non line-of-sight locations.

In one embodiment, the jet nozzles used in the inventive system are smaller and narrower than conventional abrasive jet nozzles because the pre-mixed abrasive and fluid does not require two separate conduits, one for the abrasive and one for the fluid, to conduct mixing within a chamber disposed just before the nozzle. As a result, multiple nozzles can be arranged closely together to drill multiple, closely-spaced holes simultaneously.

DETAILED DESCRIPTION OF THE EMBODIMENTS

Figure 1:
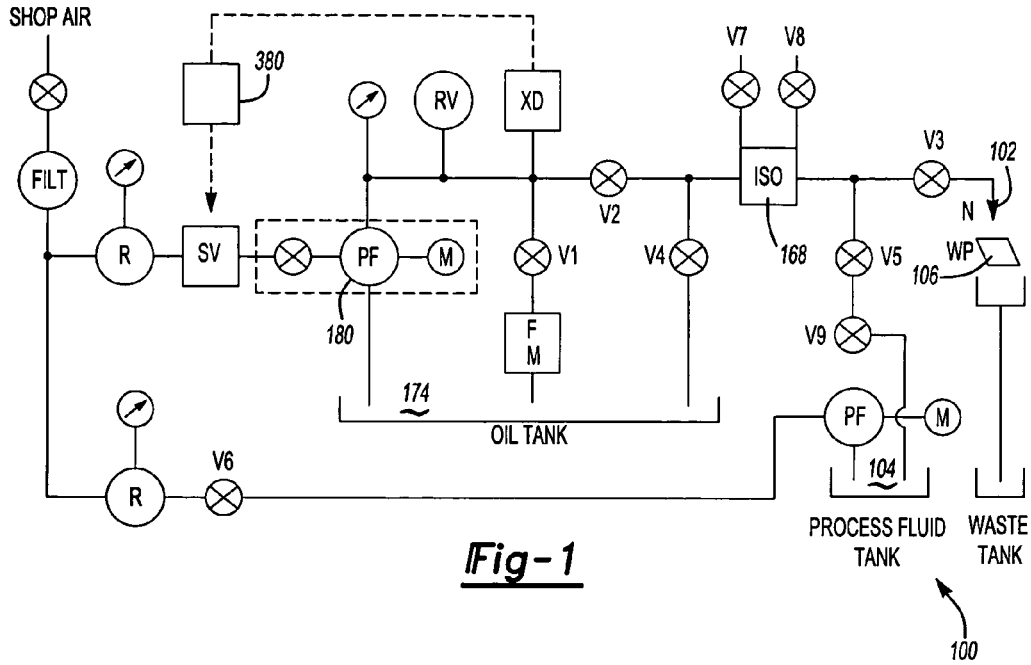
FIG. 1 is a schematic diagram illustrating the general concepts of a system according to one embodiment of the invention.

FIG. 1 is a schematic diagram illustrating various primary components of a drilling system 100 according to one embodiment of the invention. Generally, the system 100 sends an abrasive working fluid 104 through one or more jet heads 102 to a target 106. The flow and pressure of the working fluid 104 is controlled by flow of a control fluid 174, such as oil, hydraulic fluid, or water, through the system 100 via a series of valves. In the schematic shown in FIG. 1, an isolator 168 prevents the working fluid 104 from contacting the control fluid 174. An air-driven intensifier pump 180 is used to control the pressure of the control fluid 174 and therefore the working fluid 104. In one embodiment, the intensifier pump 180 is able to produce 10,000 psi of control fluid 174 at up to 6 gallons/minute with no compressible or inertial stored energy via control of a high-speed pneumatic servo valve SV.

The isolator 168 is charged by manipulation of various valves in the system 100. In the illustrated schematic, for example, the isolator 168 may be charged by closing valves V2 and V3, opening valves V4 and V5, and then opening valve V6 to cause the working fluid 104 to be pumped into the isolator 168 and displace the control fluid 174 to, for example, a tank through another valve V4. To send the working fluid 104 to the jet head 102 and begin drilling, valves V2 and V3 are opened and valves V4 and V5 are closed.

A pressure controller 380 may use various pressure/time profiles to control flow of the control fluid 174 at various pressures via controller software. More particularly, the steady state and dynamic response of the system 100 can be controlled by the controller 380, a transducer XD, the pneumatic servo valve SV, and one or more pumps PF. A flowmeter FM may be used to measure the flow of the control fluid 174. A needle valve V1 or other valve sets the steady state and dynamic response of the system 100. Note that the valve V1 may be controlled to allow an abrupt fluid pressure drop at the end of a drilling cycle, if desired.

Figure 2A:
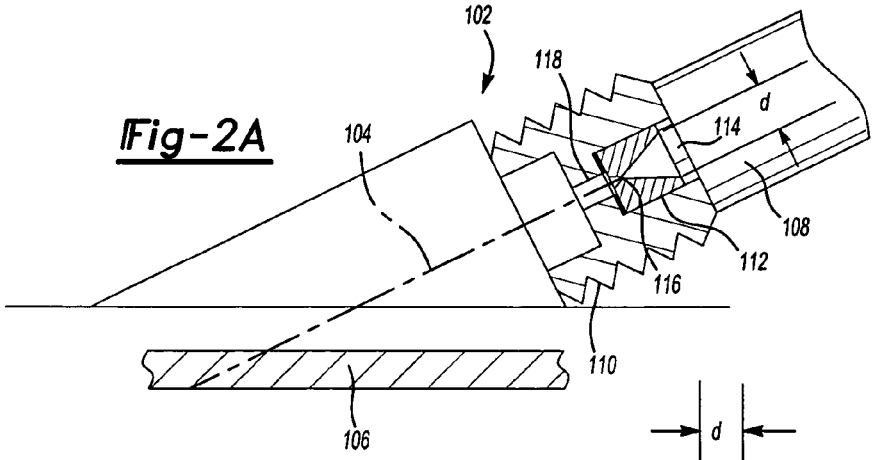
FIGS. 2A, 2B and 2C are representative diagrams of a jet head used in one embodiment of the present invention.
Figure 2B:
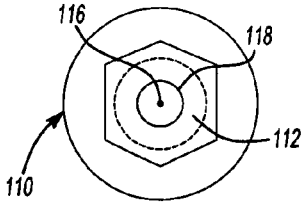
Figure 2C:
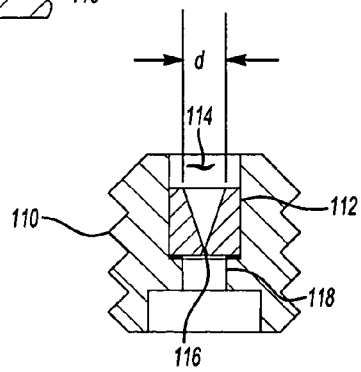

Various embodiments of the overall system shown in FIG. 1 will now be described below in greater detail. FIGS. 2A, 2B and 2C are representative diagrams illustrating a jetting portion of a hole drilling system 100 according to one embodiment of the invention. Although FIGS. 2A and 2B illustrate a single nozzle, a given system can contain multiple nozzles, which will be explained in greater detail below. The device shown in FIG. 2 is the jet head 102, which directs a coherent jet of the working fluid 104 to the target 106. The working fluid 104 is a water/abrasive suspension. As shown in FIG. 2, the jet head 102 structure includes a feed tube 108 that directs a flow of the working fluid 104 to a nozzle holder 110. The nozzle holder 110 allows different nozzles to be connected to the system so that the same system 100 can be easily adapted to drill different-sized holes. The nozzle holder 110 may be machined from a standard hex socket stainless steel set screw (e.g., a standard 4–40 hex socket set screw) to form a threaded holder structure.

In one embodiment, the nozzle holder 110 retains a poly-crystalline diamond (PCD) nozzle 112, which typically has an orifice opening in the range of 0.003 to 0.020 inches. A high pressure coherent abrasive suspension jet of working fluid 104 (e.g., 10,000 psi) forced through a poly-crystalline diamond nozzle 112 having an orifice diameter of, for example, 0.005 inches will produce a highly collimated jet stream of working fluid 104 that can drill a hole in the target 106. Because the jet stream of working fluid 104 is designed to have abrasive particles suspended in it, as will be explained in greater detail below, no further collimation of the jet of working fluid 104 is needed.

The poly-crystalline diamond nozzle 112 may be drilled so that it has an entrance 114 having a wider diameter d that tapers inward toward a small orifice 116 diameter before tapering back outward slightly. The nozzle 112 dimensions are selected to accommodate this tapering. For example, the poly-crystalline diamond nozzle 112 diameter itself may be around 0.050 inches in diameter by 0.040 inches long, while the entrance 114 may have a diameter d of 0.025 inches that eventually tapers to an orifice diameter of 0.005 inches. This large taper reduces fluid turbulence as the fluid travels from the feed tube 108 into the nozzle 112, producing a fluid stream with reduced divergence.

In one embodiment, the outer diameter of the nozzle 112 and the inner diameter of the nozzle holder 110 are dimensioned so that the nozzle 112 slip-fits into the nozzle holder 110. A lip 118 extending from the inner diameter of the nozzle holder 110 holds the nozzle 112 in position. The poly-crystalline diamond nozzle 112 is sealed to the nozzle body 110 by brazing or other suitable means to seal against leakage from the high fluid pressure in the feed tube 108.

As can be seen in FIG. 2, the structure of the jet head 102 can be kept simple because the fluid and the abrasive are already mixed before they even enter the inlet feed tube 108 of the jet head 102, eliminating the need for separate fluid and abrasive tubes or any mixing chamber within the jet head. Pressures in the system 100 can typically range from 5,000 to 15,000 psi, but there are no upper or lower pressure limits and any pressure coupled with compatible abrasive grades and nozzle orifice diameters can be used in the system. Because the jet head 102 is so simple and does not require a focusing tube to direct the jet stream of working fluid 104, the jet stream can drill holes with diameters as small as 0.003 inches cleanly and without any metallurgical damage to the material surrounding the hole.

The fluid forming the jet stream of working fluid 104 is a fluid having abrasive particles suspended in a carrier fluid without settling. This suspension allows the fluid to be pumped through the nozzle 112 and eliminate the need to add abrasive at a later stage or constantly stir or agitate a slurry of the abrasive. The fluid may formed by adding fluid additives to water to control the viscosity of the fluid; in one embodiment, the fluid is a solution of around 3.9 percent by volume to increase the fluid viscosity to more than 9,000 centipoises. The fluid may use a methyl cellulose/water mixture or other long-chain polymer/water mixture as the viscous medium within which to suspend the abrasive particles. A typical viscoelastic fluid is marketed by Berkeley Chemical Company under the brand name "Superwater" and is a methacrylamide/water mixture. The abrasive particles themselves may be any non-hygroscopic material, such as 50 micron particles of garnet. Other materials, such as alumina, silica, or silicon carbide, may also be used as the abrasive. The abrasive particles may be mixed with the high viscosity fluid at a concentration of around 53 grams/liter. The fluid additive and the abrasive particles may be added to water in separate stages using an orbital mixer to ensure optimum mixing.

The high viscosity of the fluid prevents settling of the abrasive particles within the solution and maintain the coherency of the abrasive suspension jet as it passes through the nozzle 112. The fluid may also have some degree of viscoelasticity to provide fluid elasticity when it hits the target, thereby maintaining a collimated jet configuration even as it hits the target. Both viscous and viscoelastic fluids effectively ensure high abrasive particle velocities as they hit the target 106 as well as maintain a small jet stream of working fluid 104 cross-sectional diameter to ensure focused hole drilling.

With a coherent abrasive suspension jet, the abrasive particles are fully wetted by the water-based suspending medium and are surrounded by the water based continuum. Therefore, there is no possibility of air entrainment in the jet as in the case of the conventional jets with a dry abrasive feed or slurry feed.

Figure 3:
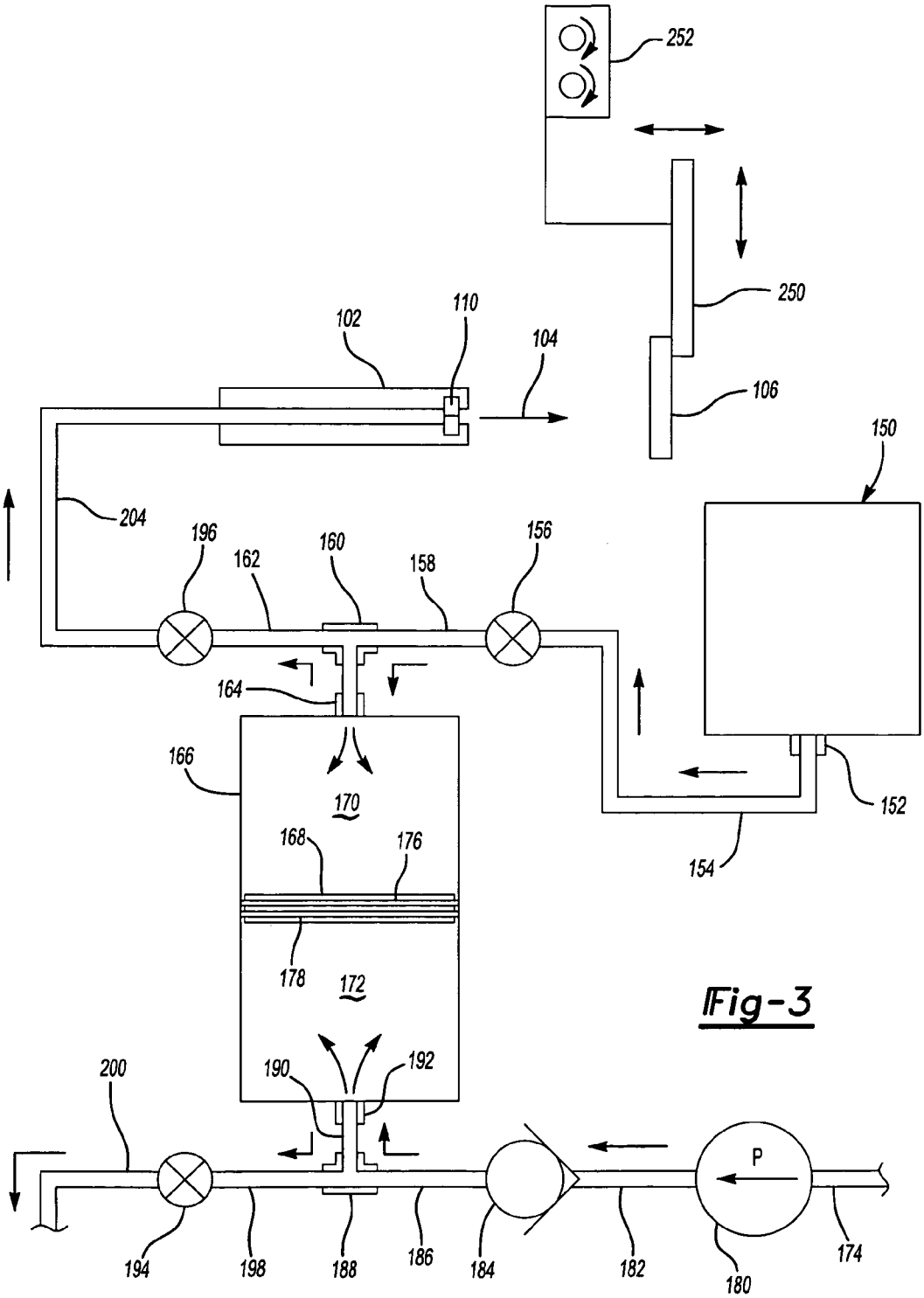
FIG. 3 is a diagram of the system shown in FIG. 1 according to one embodiment of the invention.

FIG. 3 is a representative diagram illustrating the overall hole drilling system 100 in greater detail. FIG. 3 shows one way in which the working fluid 104 is transported to the jet head 102 and expelled toward the target 106. The working fluid 104 is retained in liquid suspension tank 150 and is forced to flow into the system by any appropriate fluid transportation method, such as using compressed air to displace the fluid from the suspension tank 150, to send the fluid through a suspension tank outlet port 152 and a suspension tank conduit 154. This flow out of the suspension tank 150 is regulated by a suspension charging valve 156. When the suspension charging valve 156 is open, the working fluid 104 is forced to flow into a suspension charging conduit 158 through a conduit T connector 160, then through a suspension port 164, and then into a piston pressure vessel, such as a floating piston cylinder 166.

In this example, the floating piston cylinder 166 is a dual chamber cylindrical vessel with the isolator 168 that divides a working fluid chamber 170 from an control fluid chamber 172. The working fluid chamber 170 holds the fluid and the suspended abrasive particles, while the control fluid chamber 172 holds control fluid 174, such as any hydraulic fluid or water. The isolator 168 may have an upper O-ring seal 176 and a lower O-ring seal 178 to ensure that no mixing occurs between the abrasive suspension working fluid 104 and the control fluid 174.

The control fluid 174 is kept under high pressure by air pressure or any other method. In one embodiment, the control fluid 174 is kept under high pressure in the control fluid chamber 172 by an air driven intensifier pump 180 at a pressure of up to 55,000 psi. The control fluid 174 is sent though the intensifier pump 180 via an intensifier pump conduit 182 and through a check valve 184. The control fluid 174 is made to flow through a conduit 186, a conduit T-connector 188, a conduit 190, and finally through an intensifier port 192 into the control fluid chamber 172.

When the suspension charging valve 156, the intensifier check valve 184, an open depressurization valve 194, and a suspension outlet valve 196 are appropriately configured, the control fluid 174 may be expelled from the control fluid chamber 172, through a port 192, conduit 190, and a depressurization conduit 198, the open depressurization valve 194, and finally through a depressurization outlet conduit 200.

To discharge the working fluid 104 out of the working fluid chamber 170, the suspension outlet valve 196 is opened to allow the working fluid 104 to jet out of the suspension port 164 through the suspension conduit 162 and the conduit T-connector 160. The fluid then flows through the suspension conduit 162, the open suspension outlet valve 196, and finally through a suspension outlet conduit 204. The suspension outlet conduit 204 carries the pressurized working fluid 104 to the nozzle holder 110 and finally through the nozzle 112 to form the pressurized fluid jet that is sent toward the target 106. The jet is then directed toward a focused point on the target 106 until it breaks through the target, thereby forming a hole.

The system shown in FIG. 3 requires the floating piston cylinder 166 to be initially charged to start working fluid 104 flow. This is conducted using the abrasive working fluid 104 by opening the suspension charging valve 156, closing the suspension outlet valve 196, opening the depressurization valve 194, and closing the intensifier check valve 184. In this valve configuration, a minimal amount of pressure applied to the working fluid 104 forces the working fluid 104 to flow out of the suspension tank 150 into the working fluid chamber 170 of the floating piston cylinder 166. This forces the isolator 168 downward, increasing the volume of the working fluid chamber 170 and decreasing the volume of the control fluid chamber 172. As a result, the depressurized control fluid 174 in the control fluid chamber 172 is forced out through the open depressurization valve 194 as described above. The control fluid 174 is then drained and removed from the system 100 via the depressurization outlet conduit 200.

Once the floating piston cylinder 166 has been charged with the abrasive suspension working fluid 104, a reverse discharge process may be conducted. To do this, the suspension charging valve 156 is closed, the suspension outlet valve 196 is opened, the depressurization valve 194 is closed, and the intensifier check valve 184 is opened. In this configuration, the control fluid 174 is forced by the intensifier pump 180 to flow through the intensifier check valve 184 into the control fluid chamber 172 as described above. The higher pressure of the control fluid 174 flowing into the control fluid chamber 172 forces the isolator 168 upward through the floating piston cylinder 166, thereby decreasing the volume of the working fluid chamber 170. The decreased working fluid chamber 170 volume forces pressurized suspended abrasive working fluid 104 out of the floating piston cylinder 166 through the suspension outlet valve 196 at the pressure of control fluid 174 as described above. From the outlet valve 196, the pressurized working fluid 104 flows through the suspension outlet conduit 204 through the nozzle holder 110 and then through the nozzle 112 as a high-pressure jet toward the target 106.

The target 106 may be disposed on a platform 250 that can be indexed to move as individual holes have been drilled through the target 106. In one embodiment, a controller 252 controls movement of the platform 250 so that the target 106 is moved relative to the nozzle 112 each time a drilled hole is complete. This allows sequential drilling of multiple holes in the same target 106.

Figure 4:
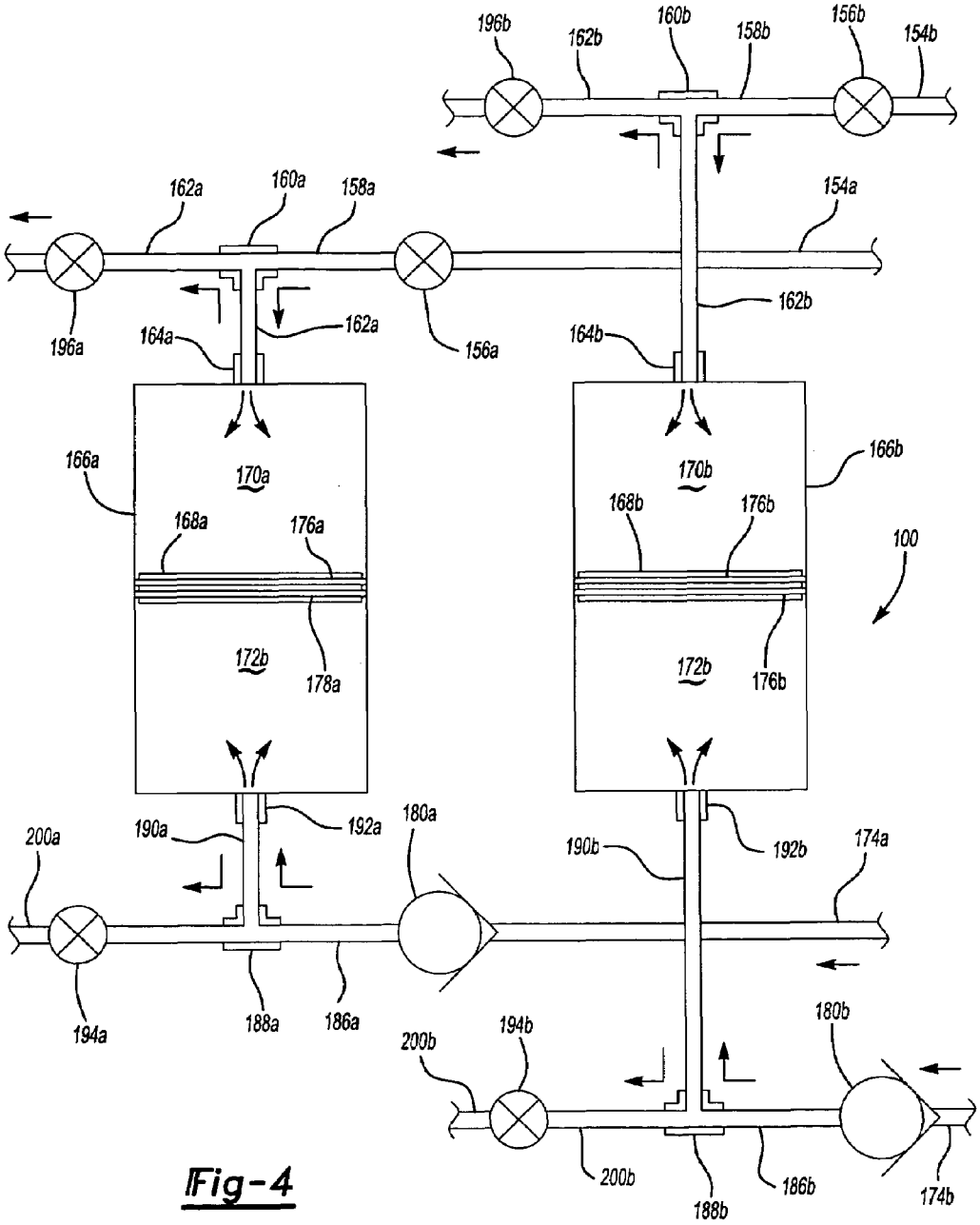
FIG. 4 is a diagram of a system according to another embodiment of the invention.

FIG. 4 illustrates an alternative embodiment of the hole drilling system shown in FIG. 3. In this embodiment, a second, parallel floating piston cylinder 166*b* is included. The components of this parallel system are identical to those described in FIG. 3 and the numbers associated with their identity are repeated in FIG. 4 with sub-indications "a" and "b" for clarity. The embodiment shown in FIG. 4 can maintain a constant jet of working fluid 104 while at the same time recharging the system. This is accomplished through various valve switching sequences, which will be explained in greater detail below.

In the embodiment shown in FIG. 4, it is assumed that the system 100 is in an initial state where a first cylinder 166*a* is charged and a second cylinder 166*b* is discharged. With the first intensifier check valve 184*a*, the second depressurization valve 194*b*, the second suspension charging valve 156*b*, and the first suspension outlet valve 196*a* in an open position, and with the first depressurization valve 194*a*, the second intensifier check valve 184*b*, the second suspension outlet valve 196*b*, and the first suspension charging valve 156*a* in a closed position, the first cylinder 166*a* is faced with intensifier pressure within its control fluid chamber 172*a* by way of the open first intensifier check valve 184*a*. This forces the first isolator 168*a* upward, which in turn forces the jet of working fluid 104 in the first cylinder 166*a* out of the first working fluid chamber 170*a* by way of the first suspension outlet valve 196*a*.

Simultaneously, the second cylinder 166*b* recharges as the jet of working fluid 104 in the second cylinder is allowed to flow through the second suspension charging valve 156*b* into the second working fluid chamber 170*b*, forcing the second isolator 168*b* downward. The downward movement of the second isolator 168*b* forces the control fluid out of the second control fluid chamber 172*b* through the open second depressurization valve 194*b* and then to the second depressurization outlet conduit 200*b*.

When the first cylinder 166*a* approaches a fully discharged state and the second cylinder 166*b* approaches a fully charged state, the second suspension charging valve 156*b* and the second depressurization valve 194*b* are closed. Closing these valves isolates the second cylinder 166*b* momentarily. The second intensifier check valve 184*b* is then opened, which pressurizes the second cylinder 166*b* by allowing it to see the control fluid via the open second intensifier check valve 184*b* into the second control fluid chamber 172*b*. The second suspension outlet valve 196*b* is then opened, placing both the first cylinder 166*a* and the second cylinder 166*b* in a discharge state. While both the first and second cylinders 166*a*, 166*b* are discharging, the suspension outlet valve 196*a* is closed to discontinue the discharging of the first cylinder 166*a*.

The first intensifier check valve 184*a* is then closed to isolate the first cylinder 166*a* and allow the first cylinder 166*a* to begin recharging. This process is initiated by opening the first depressurization valve 194*a*, which allows the depressurization of the first control fluid chamber 172*a* and therefore allows the control fluid to flow out of the first control fluid chamber 172*a*. At the same time, the first suspension charging valve 156*a* is opened to allow the working fluid 104 to flow into the first working fluid chamber 170*a*. During the time the first cylinder 166*a* is recharging, the second cylinder 166*b* continues to discharge the fluid jet 104 through the nozzle 112.

The same sequence of valve openings and closings occurs when the first cylinder 166*a* has been fully charged and the second cylinder 166*b* is nearing a full discharge state. This transition sequence of discharging and charging the first and second cylinders 166*a*, 166*b* can be carried on indefinitely as long as sufficient abrasive working fluid 104 is supplied from the suspension tank 150 and as long as control fluid 174 is supplied through the intensifier pump 180.

Regardless of the specific system used to drill holes, the pressure of the working fluid 104 impinging the target can be adjusted if desired to prevent the jet from creating a ricochet pattern as the abrasive particles bounce off the target, creating a knife edge or otherwise unclean drilling pattern. To do this, the drilling process may start at a low pressure and gradually increase to a high, target pressure once the jet has engaged with the material by breaking past its surface. By varying the jet pressure in this manner, it is possible to create a clean hole without any defective cuts due to ricochet of the abrasive particles off of the target. Moreover, varying the jet pressure can control the configuration of the hole itself.

In one embodiment, if the inventive system is used to drill holes having a desired profile, a pressure controller 380 may control a time/pressure profile of the fluid while drilling an entry portion of a hole, then use a different time/pressure profile while drilling a middle portion of a hole and then using yet another time/pressure profile to shape the exit geometry of the hole. These differing time/pressure profiles allows the same nozzle 112 to drill a hole having slight variations in geometry.

Note that the pressure controller 380 can also control the time/pressure profile of the fluid to allow tapering of the working fluid 104 during the drilling cycle to generate non-circular, shaped holes in the target 106. Alternatively, the orifice 116 of the nozzle 112 may be formed with non-circular, sectional areas to produce a working fluid 104 stream with a profile that can drill a hole with a desired shape. By controlling the time/pressure profile and/or the shape of the orifice 116, it is also possible to drill holes having a non-uniform profile (e.g., a hole with different dimensions on either side of the target or a hole with varying dimensions along its length). Thus, the system provides a great deal of flexibility on hole shaping with minimal adjustment.

Figure 5A:
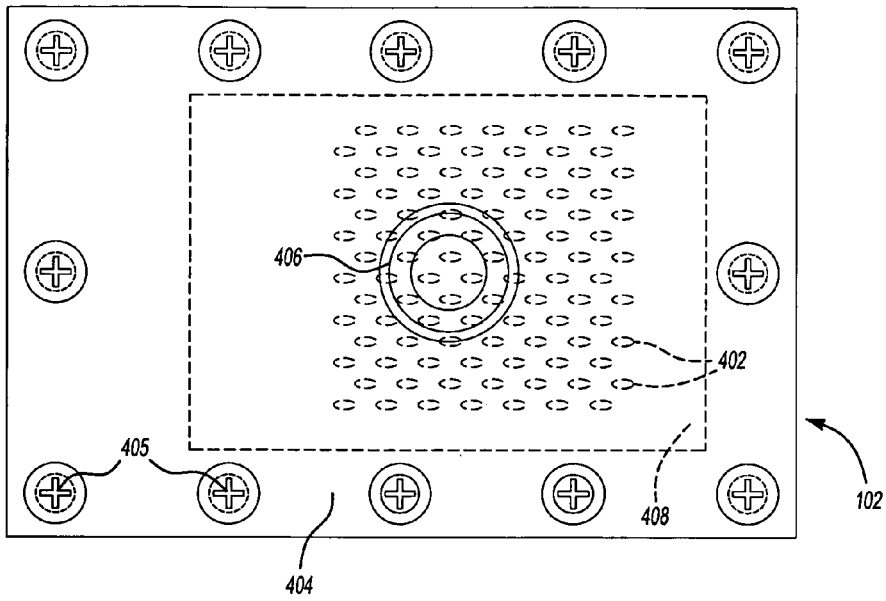
FIGS. 5A and 5B are representative diagrams of one example of a jet head that can be used in the inventive system.
Figure 5B:
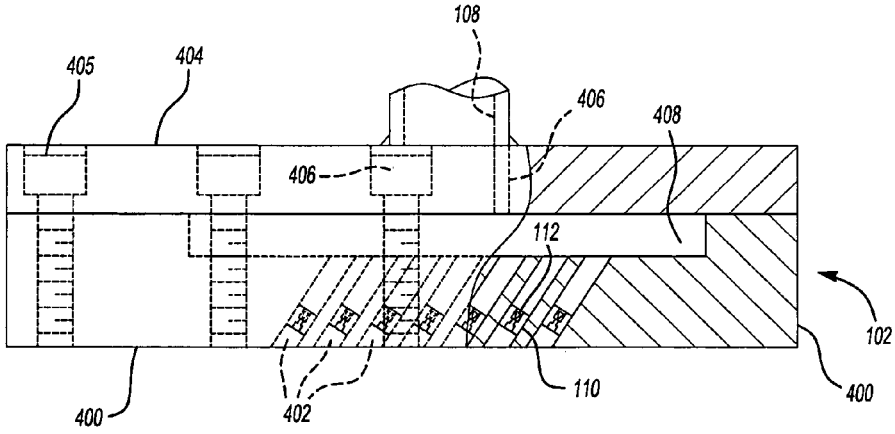

FIGS. 5A and 5B illustrates an example of a multiple-conduit configuration that can drill multiple holes simultaneously. As noted above, the simple structure of the nozzle holder 110 and the nozzle 112 allows multiple nozzles 112 to be arranged close together to drill closely-spaced holes in the target 106. Moreover, the small profile of the nozzle holder 110 and nozzle 112 allows the nozzles 112 to be arranged so that the holes are drilled at an angle in a selected pattern. The inventive system and method therefore allows multiple holes to be drilled simultaneously under limited clearances, even in non-line of sight locations and on curved surfaces, while preserving the highest possible metallurgical quality in the target 106 even if the target 106 has a coating (e.g., a thermal barrier coating).

As shown in the plan view of FIG. 5A and the section view of FIG. 5B, the jet head 102 can be configured in the form of a block 400 having a plurality of conduits 402 that can accommodate multiple nozzle holders 110 and therefore multiple nozzles 112. A cover 404 is held to the block 400 with screws or other fasteners 405. The cover 404 has an opening 406 that accommodates the feed tube 108. The block 400 has a milled plenum 408 that distributes fluid from the feed tube 108 to the nozzles 112 held in the conduits 402 by the nozzle holders 110. This ensures that the fluid is expelled from the multiple nozzles 112 simultaneously to drill multiple holes.

In one embodiment, if threaded nozzle holders 110 are used, the diameters of the conduits 402 are the same as the tap drill diameter of the nozzle holders 110 so that the nozzle holders 110 can be screwed into and form a close fit within the conduits 402. Using threaded nozzle holders 110 allows the nozzle holders 110 and the nozzles 112 to be easily removed and replaced. In the configuration shown in FIGS. 5A and 5B, it is possible to place nozzles 112 having different diameters in the same block 400, providing flexibility in the final drilling pattern.

Note that although the illustrated embodiment shows the conduits 402 generally parallel to each other, the conduits 402 can be disposed at any angle and any direction and may even intersect, depending on the desired hole drilling pattern. Moreover, the conduits 402 may be arranged at an angle with respect to the surface of the block 400. In other words, the conduits 402 can be disposed in any orientation with respect to each other and with respect to the block surface depending on the desired hole configuration to be drilled.

In one example, the working fluid 104 used to drill multiple targets is a room temperature, water-based fluid having 50 micron abrasive particles of garnet suspended in the fluid at 52.8 grams per liter. In this example, a long molecular chain acrylic polymer is added at 3.9% by volume to increase the viscosity of the fluid and keep the abrasive particles suspended in the fluid. The jet head 102 contains multiple nozzles 112 that are arranged in a desired configuration. In the example shown in FIGS. 5A and 5B, the orifices 116 are on the order of 0.005 inches in diameter and the bodies of the nozzles are on the order of 0.050 inches in diameter by 0.040 inches thick and brazed or otherwise attached into position within the nozzle body 110, which are threaded into the conduits 402 at an angle of around 30 degrees. In one embodiment, the nozzles 112 are made of a poly-crystalline diamond material or other material with suitable wear resistance. The nozzles 112 may be staggered to form a desired hole pattern. During drilling, each nozzle 112 is fed by a 0.040 inch diameter conduit at a rate of approximately 1.0 cc/second to generate a plurality of parallel holes. Note that the orientation and relative positions of the nozzles 112 can be easily adjusted via any known manner to produce non-parallel holes on non-planar surfaces without departing from the scope of the invention. The plurality of fluid jets is positioned during the impinging step so that the plurality of the holes are separate from each other, with each of said plurality of holes defining a boundary, and said plurality of holes not being positioned within the boundary of another of said plurality of holes.

By drilling multiple holes at the same time, the inventive method and system can rapidly produce parts having a plurality of holes without sacrificing the quality of the holes and preserving the metallurgical characteristics of the material around the holes. Further, the inventive hole drilling system and method can cleanly drill through materials other than metal, including composites and ceramics, at rapid dates due to the high fluid pressure and the non-thermal grinding action of the abrasive particles.

It should be understood that various alternatives to the embodiments of the invention described herein may be employed in practicing the invention. It is intended that the following claims define the scope of the invention and that the method and apparatus within the scope of these claims and their equivalents be covered thereby.

What is claimed is:

1. A hole drilling method, comprising:

combining water, abrasive particles, and a viscosity-enhancing material to form an abrasive suspension working fluid;

pressurizing the working fluid;

expelling the pressurized working fluid simultaneously through a plurality of nozzles to produce a plurality of high velocity coherent fluid jets; and impinging the plurality of fluid jets simultaneously onto a plurality of target locations for a sustained time period until the fluid jets break through the target locations to form a plurality of holes.

2. The method of claim 1, wherein the pressurizing step comprises:

storing the working fluid in a fluid reservoir; and conducting the working fluid from the reservoir to a pressurizing cylinder, wherein the pressurizing cylinder receives the working fluid at a first pressure and discharges the working fluid simultaneously through the plurality of nozzles at a second pressure, wherein the second pressure is greater than the first pressure.

3. The method of claim 1, wherein the viscosity-enhancing material used in the combining step is a long-chain polymer.

4. The method of claim 1, wherein the abrasive particles used in the combining step are made from a non-hygroscopic material.

5. The method of claim 4, wherein the abrasive particles are selected from the group consisting of garnet, alumina, silica, and silicon carbide.

6. The method of claim 1, further comprising varying a time/pressure profile in the expelling step to control a shape of at least one of said plurality of holes.

7. The method of claim 1, wherein said plurality of fluid jets are positioned during the impinging step so that a plurality of the holes are separate from each other, with each of said plurality of holes defining a boundary, and said plurality of holes not being positioned within the boundary of another of said plurality of holes.

8. A jet head for a hole drilling system, comprising:

a block having a plurality of conduits;

a plurality of nozzles disposed in the plurality of conduits; and a plenum to fluidically couple the plurality of nozzles to a feed tube to distribute fluid from the feed tube to said plurality of nozzles, and wherein said plurality of nozzles being positioned to form a plurality of distinct and separate holes in a work piece.

9. The jet head of claim 8, wherein the plurality of conduits are disposed substantially parallel to each other.

10. The jet head of claim 8, wherein at least one of the plurality of conduits are arranged at an angle with respect to a plane of the block.

11. The jet head of claim 8, further comprising a plurality of nozzle holders that removably hold the nozzles in said plurality of conduits.

12. The jet head of claim 11, wherein each of said plurality of nozzle holders has an outer diameter that is threaded and an inner diameter that holds one of said plurality of nozzles.

13. The jet head of claim 12, further comprising a lip extending from the inner diameter of the nozzle holder, wherein the lip locates the nozzle.

14. The jet head of claim 11, wherein at least one of said plurality of nozzles is brazed to at least one corresponding nozzle holder.

15. The jet head of claim 8, wherein at least one of said plurality of nozzles is a poly-crystalline diamond.

16. The jet head of claim 8, further comprising a cover attached to the block, wherein the cover has an opening to accommodate the inlet plenum.

17. The jet head of claim 8, wherein said plurality of nozzles includes at least one nozzle having an orifice of a first diameter and a second nozzle having an orifice of a second diameter different from the first diameter.

18. The jet head of claim 8, wherein each of said plurality of nozzles has an entrance with a first diameter that tapers toward an orifice with a second diameter smaller than the first diameter.

19. The jet head of claim 8, wherein said plurality of nozzles includes at least one nozzle having an orifice with a non-circular sectional area.

20. A hole drilling system, comprising:

a pressure vessel having an isolator that separates the pressure vessel into a control fluid chamber that houses a control fluid and a working fluid chamber that houses an abrasive suspension working fluid containing water, abrasive particles, and a viscosity-enhancing material;

a pressure source that pressurizes the control fluid in the pressure vessel to force the working fluid out of the pressure vessel; and a jet head having a plurality of nozzles that expel the working fluid to produce a plurality of high velocity coherent fluid jets that simultaneously impinge a plurality of target locations for a sustained time period until the plurality of fluid jets break through the target location to form a plurality of holes.

21. The hole drilling system of claim 20, wherein the isolator comprises a floating piston.

22. The hole drilling system of claim 20, wherein the isolator comprises a diaphragm.

23. The hole drilling system of claim 20, further comprising a controller that controls operation of a the-pump.

24. The hole drilling system of claim 23, wherein the controller controls the pump according to a time/pressure profile.

25. The hole drilling system of claim 20, wherein said plurality of fluid jets being so positioned during the impinging step such that said plurality of the holes are separate from each other, with each of said plurality of holes defining a boundary, and said plurality of holes not being positioned within the boundary of another of said plurality of holes.

* * * * *

UNITED STATES PATENT AND TRADEMARK OFFICE

CERTIFICATE OF CORRECTION

PATENT NO. : 7,186,167 B2
APPLICATION NO. : 10/825524
DATED : March 6, 2007
INVENTOR(S) : Frederick R. Joslin It is certified that error appears in the above-identified patent and that said Letters Patent is hereby corrected as shown below:

Column 10, line 51: Delete "the" which is before "pump" and after the second occurrence of "a"

Signed and Sealed this

Twenty-sixth Day of February, 2008

JON W. DUDAS
*Director of the United States Patent and Trademark Office*